US009375717B2

(12) United States Patent
Zhu

(10) Patent No.: US 9,375,717 B2
(45) Date of Patent: Jun. 28, 2016

(54) MULTI-FUNCTIONAL PAIR OF CRUSHING PLATES CAPABLE OF SELF-TRIMMING

(75) Inventor: Xingliang Zhu, Yiwu (CN)

(73) Assignee: ZHEJIANG SHENGDA MACHINERY CO.LTD, Yiwu, Zhejiang (CN)

( * ) Notice: Subject to any disclaimer, the term of this patent is extended or adjusted under 35 U.S.C. 154(b) by 347 days.

(21) Appl. No.: 14/006,085

(22) PCT Filed: Mar. 26, 2012

(86) PCT No.: PCT/CN2012/073071

§ 371 (c)(1),
(2), (4) Date: Sep. 18, 2013

(87) PCT Pub. No.: WO2012/130127

PCT Pub. Date: Oct. 4, 2012

(65) Prior Publication Data

US 2014/0008476 A1 Jan. 9, 2014

(30) Foreign Application Priority Data

Mar. 28, 2011 (CN) ..... 2011 2 0084316 U

(51) Int. Cl.
*B02C 1/10* (2006.01)
*B02C 1/04* (2006.01)

(52) U.S. Cl.
CPC .... *B02C 1/10* (2013.01); *B02C 1/04* (2013.01)

(58) Field of Classification Search
CPC ..... B02C 1/10; B02C 1/04
USPC ..... 241/264–269
See application file for complete search history.

(56) References Cited

FOREIGN PATENT DOCUMENTS

| | | | |
|---|---|---|---|
| CN | 2274528 | Y | 2/1998 |
| CN | 102198410 | A | 9/2011 |
| CN | 202028419 | U | 11/2011 |
| JP | 8-229417 | A | 9/1996 |
| JP | 2007/117930 | A | 5/2007 |
| JP | 2007-253074 | A | 10/2007 |

*Primary Examiner* — Mark Rosenbaum

(57) ABSTRACT

A multi-functional pair of crushing plates capable of self-trimming is disclosed. The pair of crushing plates includes a fixed jaw plate (5) and a movable jaw plate (4). The fixed jaw plate (5) and the movable jaw plate (4) both have base boards (11). The base board (11) has a plurality of tooth peaks (12) and tooth troughs (13). The tooth peaks (12) and the tooth troughs (13) on the fixed jaw plate (5) and the movable jaw plate (4) are arranged oppositely and intersectedly. The tooth troughs (13) have holes (14) perforated through the base boards (11). The holes (14) are arranged in columns along a direction of a length of the tooth peak (12) on the base board (11) opposite to the holes (14).

4 Claims, 3 Drawing Sheets

MULTI-FUNCTIONAL PAIR OF CRUSHING PLATES CAPABLE OF SELF-TRIMMING

CROSS REFERENCE OF RELATED APPLICATION

This is a U.S. National Stage under 35 U.S.C. 371 of the International Application PCT/CN2012/073071, filed Mar. 26, 2012, which claims priority under 35 U.S.C. 119(a-d) to CN 201120084316.5, filed Mar. 28, 2011.

BACKGROUND OF THE PRESENT INVENTION

1. Field of Invention

The present invention relates to a jaw crusher, and more particularly to a multi-functional pair of crushing plates capable of self-trimming.

2. Description of Related Arts

The jaw crusher is a crusher who accomplishes crushing materials via a pair of crushing plates comprising a movable jaw plate and a fixed jaw plate which imitates a double-jaw movement of an animal. The jaw crusher is widely applied for a medium grain size crush of various ores and big blocks of materials in various industries, such as mining, smelting, building material, roads, railways, water conservancy and chemical industry.

The jaw plate, also knows as teeth plate, is an important component of the jaw crusher. The production efficiency, the crush effects, the power consumption and the abrasion of the jaw crusher are directly related to the pair of crushing plates comprising the two jaw plates which decides the performance of the whole jaw crusher to a great extent. Therefore, the jaw plate is the first target for improve the jaw crusher technology. Improvements and innovations are usually made from following aspects: materials and a manufacturing process of the jaw plate; a geometric structure of the jaw plate; and shapes of the tooth peak and the tooth trough. The "tooth-shaped structure" of the tooth peak and the tooth trough of the jaw plate is the most basic and essential design of the jaw plate structure.

Practically, the "tooth-shaped" jaw plate has much better crush performance than the jaw plate of a "solid flat board". Thus the "tooth-shaped" jaw plate is still used ever since the emergence of the jaw crusher.

The conventional jaw crushers usually have the "tooth-shaped" jaw plate, rather than the jaw plate of the "solid flat board", for following two reasons. Firstly, the "tooth-shaped" jaw plate has a relatively small contact area with the materials to be crushed and thus a relatively strong crushing pressure; secondly, the "tooth-shaped" jaw plate is able to accomplish an improved crush mechanism of chopping, bending and squeezing, so as to improve the crush efficiency.

In order to maintain that the tooth shape is strong enough, the jaw plate is manufactured into the structure of a narrowed top and a widen bottom, in such a manner that the tooth tops gradually wear in the process of crushing to become increasingly wide and the "toothed shaped" gradually declines into a nearly flat shape along with the wearing. During the service life of the jaw plate, the "toothed shape" is obviously effective for only ⅕~⅓ of the service life and works at a sub-flat state to accomplish crushing for most of the service life. Practically, the "toothed shape" functions quite limitedly.

As a result, all the improvements and innovations about the "toothed shape" so far have a common disadvantage that the "toothed shape" is most effective originally and then gradually weakens along with the wearing of the "toothed shape".

SUMMARY OF THE PRESENT INVENTION

An object of the present invention is to overcome the disadvantage that the conventional jaw crusher has a poor crushing capability and low production efficiency because of the worn teeth of the jaw plate and to provide a pair of crushing plates which is capable of self-trimming, simple and cheap and has a strong crushing capability and a high production efficiency.

Accordingly, in order to accomplish the above objects, the present invention adopts following technical solutions. A multi-functional pair of crushing plates capable of self-trimming comprises a fixed jaw plate and a movable jaw plate, wherein the fixed jaw plate and the movable jaw plate both have base boards and the base board has a plurality of tooth peaks and tooth troughs. The plurality of the tooth peaks and the tooth troughs provided on the fixed jaw plate and the movable jaw plate are arranged oppositely and intersectedly. The tooth troughs have through-holes perforated through the base board and the holes are respectively arranged in columns at a direction of a length of the tooth peak provided on the base board opposite to the holes.

A first technical feature of the pair of crushing plates, provided by the present invention, is that the fixed jaw plate and the movable jaw plate are limited to be V-shaped and the tooth peaks and the tooth troughs are arranged oppositely and intersectedly, in such a manner that ores within a crushing cavity is crushed from top to bottom and from big to small via following three manners. Firstly, when the ores are provided at a top part of the crushing cavity, the ores are crushed via a chopping manner because the ores are relatively big in size and a distance between the two tooth peaks is negligible; secondly, when the ores are provided in a middle part of the crushing cavity, the ores are crushed via a bending manner because the ores are relatively intermediate in size and the distance between the two tooth peaks is functional since mutually stressed points of the opposite tooth peaks are obviously staggered; thirdly, when the ores are provided at a bottom part of the crushing cavity, the ores are crushed via a squeezing manner (a pressing manner) because the ores are relatively small in size and thus able to enter the tooth troughs. The above crushing manners greatly improve the crushing capability and the efficiency of the pair of crushing plates. The opposite and intersect arrangement of the tooth peaks and the tooth troughs provided on the fixed jaw plate and the movable jaw plate reduces a size of an exit at a bottom of the crushing cavity, which produces crushed ores with smaller grain sizes.

A second technical feature of the pair of crushing plates, also a key feature, lies on the pair of crushing plate capable of self-trimming. According to prior arts, the jaw plates of the pair of crushing plates only have the tooth peaks worn and are gradually becoming flat while the tooth peaks are being worn, which leads to low crushing efficiency. The jaw plates of the pair of crushing plates, provided by the present invention, have the tooth peaks and the tooth troughs alternatively worn, which means that the tooth peaks and the tooth troughs are both worn, in such a manner that the jaw plates are capable of self-trimming naturally during crushing and are always functioning at a best crushing efficiency.

The self-trimming is accomplished via following principles. The tooth peaks and the tooth troughs of the two jaw plates of the pair of crushing plates are arranged oppositely and intersectedly, i.e., the tooth peak faces against the tooth trough; the tooth trough is 40%~80% hollow in cross section; and thus the tooth troughs are worn before the tooth peaks when the tooth troughs are not deep yet. However, it is limited for the tooth troughs to be worn faster than the tooth peaks and the tooth troughs keep being worn fast until being worn out. Since a distance between the two tooth peaks, i.e., a width of the tooth troughs, is constant, when a depth of the tooth troughs gets close to the width of the tooth trough, crushing and wearing between the tooth peaks and the tooth troughs gradually decrease; and the tooth troughs stop being crushed and worn when deep to a certain degree, i.e., no more wearing, when the tooth peaks are still crushing big-sized materials larger than the width of the tooth troughs and thus keep being worn. When the tooth peaks are worn to a certain degree, the tooth troughs turn to be shallow again and start to crush and wear again, i.e., wearing begins again. Such cycle keeps repeating, in such a manner that the tooth peaks and the tooth troughs are always balanced at a certain value naturally during the crushing, which means that a relatively constant toothed shape is maintained, so as to accomplish self-trimming naturally during the crushing.

With the self-trimming capability, the toothed shape of the jaw plates is able to fully accomplish an improved crush mechanism comprising the chopping, the bending and the squeezing via the toothed shape.

Firstly, the jaw plates are always sharp and narrow as the toothed shape because of self-trimming, which leads to a small contact area between the tooth tips and the materials; thus the chopping manner is always effective, which improves the crushing efficiency.

The chopping is accomplished via following principles. When the materials are positioned on blade-shaped metals having shape edges to be squeezed, the sharp edges or the shape blades are wedged into the materials to form cracks; then the materials form tensile stress internally. When the tensile stress reaches a strength limit, the materials are chopped off to be broken.

Secondly, the toothed shape is always sharp and narrow because of self-trimming and the bending manner formed via the intersected two jaw plates is enhanced, which further improves the crushing efficiency.

The bending is accomplished via following principles. The materials are provided on metal convex edges which are spaced at a certain interval at one side and squeezed by the convex edges at an opposite side, in such a manner that the materials are bent and transformed; when a bending stress reaches a strength limit, the materials are bent down to be broken.

Thirdly, the jaw plates maintain space of the tooth troughs because of self-trimming and the squeezing manner is highly successful, which further improves the crushing efficiency.

The squeezing manner is accomplished via following principles. When the materials have a size close to the distance between the tooth peaks or the width of the tooth troughs provided on the jaw plate at the side, the materials are squeezed when being pressed by the jaw plate at the opposite side, just like squeezing a toothpaste; a small part of peripheries of the squeezed materials peels off and then is squeezed out, which forms the squeezing manner.

The pair of crushing plates, provided by the present invention, also has an advantage of fully accomplishing filing and shearing.

The filing is accomplished via following principles. When the materials are positioned at intersect parts of the two jaw plates, laterals of the materials are squeezed by surfaces of the blade-shaped metals, just like being filed by a file; when the filing stress formed at stressed points of the materials reaches a strength limit, the peripheries of the materials are filed to be broken. The shearing is accomplished via following principles. When the materials are positioned at the intersect parts, fronts of the materials are squeezed by the surfaces of the blade-shaped metals, just like being sheared by a shear; when the shearing stress formed at stressed points of the materials reaches a strength limit, the materials are sheared to be broken.

The pair of crushing plates having the holes, provided by the present invention, is a good combination of a file and a shear, through which the materials are broken in manners of filing and shearing, also most basic crushing manners. The anti-shearing stress strength of the materials is usually much lower than the anti-pressing stress strength thereof, so the crushing via the shearing manner is more efficient than the crushing via the pressing manner.

Having the functions of crushing via filing and shearing, the pair of crushing plates provided by the present invention obtains a strong biting force. The strong biting force greatly contributes to crushing. Specifically, the pair of crushing plates has a strong ability of in-taking (eating) the materials when the materials are positioned at the top of the crushing cavity; the materials are in-taken towards the bottom while being crushed during the whole process of crushing, i.e., the materials are pushed towards the exit direction simultaneously while being crushed, which improves the crushing efficiency.

As a conclusion, the pair of crushing plates provided by the present invention improves a crushing mechanism of the conventional jaw crusher and obtains better performance.

Besides, the pair of the crushing plates provided by the present invention has following beneficial effects.

(1) The jaw plates are processed with quenching heat treatment during a manufacture process, i.e., the jaw plates heated to be blazing are immersed into water to be cooled rapidly to accomplish quenching and hardening. The thickly dotted holes on the jaw plates greatly enlarge a contact area between the jaw plates to be quenched and water and improve hardenability of the quenching art, so as to improve hardness and abrasion resistance of the jaw plates and elongate a service life of the jaw plates.

(2) The movable jaw plate is driven by a driving axle to move along an elliptical orbit and the holes are arranged in columns within the tooth troughs. Because of the above force and structure, the ores within the crushing cavity are grated "by a washboard". Such a crushing manner improves the crushing efficiency.

(3) Because the toothed shape is capable of self-trimming, the tooth heights, the tooth widths, the tooth interval and the tooth number of the pair of crushing plates can be processed with optimization treatment, such as narrowing the tooth width, lowering the tooth height, enlarging the tooth interval and reducing the tooth number. Thus the pair of crushing plates has advantages of an enhanced bending capability because of the enlarged tooth interval, an increased intensity of pressure and an improved crushing efficiency by reducing the contact area between the tooth tips and the ores while applying identical forces onto the ores, according to an equation that the intensity of pressure is equal to the pressure divided by the contact area.

Preferably, the holes are through-holes perforated through the base boards. Via the through-holes, the materials having a size of finished products quit the crushing cavity advancedly, so as to avoid over-crushing the materials and save energy. The holes can also be blind holes. If the holes are the blind holes, a function of crushing the materials with the materials is accomplished. The jaw plates of the present invention have a plurality of the holes; during the crushing, the holes are filled with the materials and then the jaw plates whose holes are filled with the materials form a mutually squeeze between the materials inside the hole and the materials within the crushing cavity during the subsequent crushing, which is the function of crushing the materials with the materials. Because a total area of the holes is more than 50% of a total area of the jaw plates, a probability of crushing the materials with the materials is very high. A mechanism of crushing the materials with the materials facilitates reducing the wearing of the jaw plates and improving efficiency of the crusher.

Preferably, a total area of all the holes within the tooth troughs is 40%~80% of a total area of the tooth troughs. Further preferably, the total area of all the holes within the tooth troughs is 40%~60% of the total area of the tooth troughs. If a cross section of the through-holes is excessively large, the jaw plates would lack strength; if the cross section of the through-holes is excessively small, it is uneasy for the tooth troughs to be worn before the tooth peaks, which means self-trimming fails.

Preferably, the holes are waist-shaped, elliptical, rectangular and rhombic. In order to improve efficiency of grating, the holes can be of one shape or a combination of shapes selected from a group consisting of waist-shaped, elliptical, rectangular and rhombic. The different holes in the same tooth trough are not only arranged in one column along a direction of a length of the tooth peaks on the jaw plate opposite to the tooth trough, but also evenly spaced.

Preferably, the width of the tooth troughs is 1.5~4 times of the width of the tooth peaks, 1.5~3 times are further preferred. In order to force the tooth troughs to be worn before the tooth peaks to accomplish self-trimming, the cross section of the tooth trough is larger than a cross section of a largest part of the tooth peak which is a connecting part between the tooth peak and the base board.

These and other objectives, features, and advantages of the present invention will become apparent from the following detailed description, the accompanying drawings, and the appended claims.

1—crusher frame; 2—transmitting wheel; 3—driving axle; 4—movable jaw plate; 5—fixed jaw plate; 6—elbow board; 7—elbow board seat; 8—connecting rod; 9—buffer spring; 10—adjusting bolt; 11—base board; 12—tooth peak; 13—tooth trough; 14—through-hole; 15—ore; 16—movable jaw.

DETAILED DESCRIPTION OF THE PREFERRED EMBODIMENT

Combined with the drawings and the preferred embodiments, the present invention is further illustrated as follows.

Figure 1:
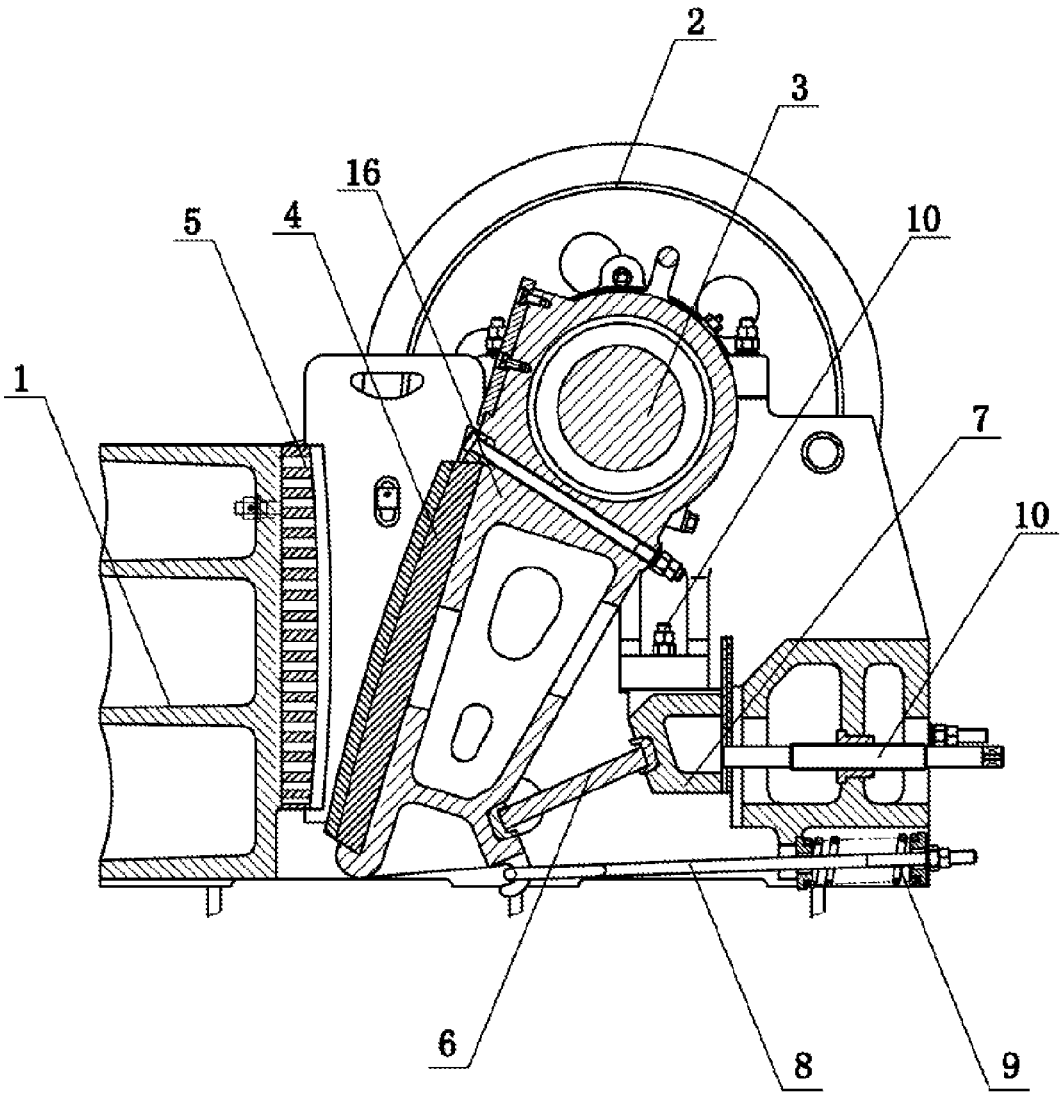
FIG. 1 is a sketch view of a pair of crushing plates according to a preferred embodiment of the present invention.

Referring to FIG. 1 of the drawings, according to a preferred embodiment of the present invention, a multi-functional pair of crushing plates capable of self-trimming comprises a crusher frame 1, a driving axle 3, a transmitting wheel 2, a pair of jaw plates, a movable jaw 16, an elbow board 6 and a connecting rod 8 which are provided on the crusher frame 1. The pair of jaw plates comprises a fixed jaw plate 5 and a movable jaw plate 4 and the fixed jaw plate 5 is mounted on the crusher frame 1. The movable jaw plate 4 is mounted on the movable jaw 16; an upper end of the movable jaw 16 is pivotally connected onto the driving axle 3 and a lower end thereof is pivotally connected onto the elbow board 6. The driving axle 3 is provided on the crusher frame 1 and connected to the transmitting wheel 2. The elbow board 6 is connected to the elbow board seat 7 which is slidably connected onto the crusher frame 1. The crusher frame 1 further comprises an adjusting bolt 10 for adjusting a sliding of the elbow board seat 7. The lower end of the movable jaw 16 is further connected to the connecting rod 8. A buffer spring 9 is provided to connect the connecting rod 8 onto the crusher frame 1.

The fixed jaw plate 5 and the movable jaw plate 4 of the pair of crushing plates both have base boards 11. Each base board has a plurality of tooth peaks 12 and tooth troughs 13. The fixed jaw plate 5 and the movable jaw plate 4 are arranged into a V-shape at an angle of 23 degrees; the tooth peaks 12 and the tooth troughs 13 are arranged oppositely and intersectedly. The tooth trough 13 is 1.5 times wider than the tooth peak 12.

Figure 2:
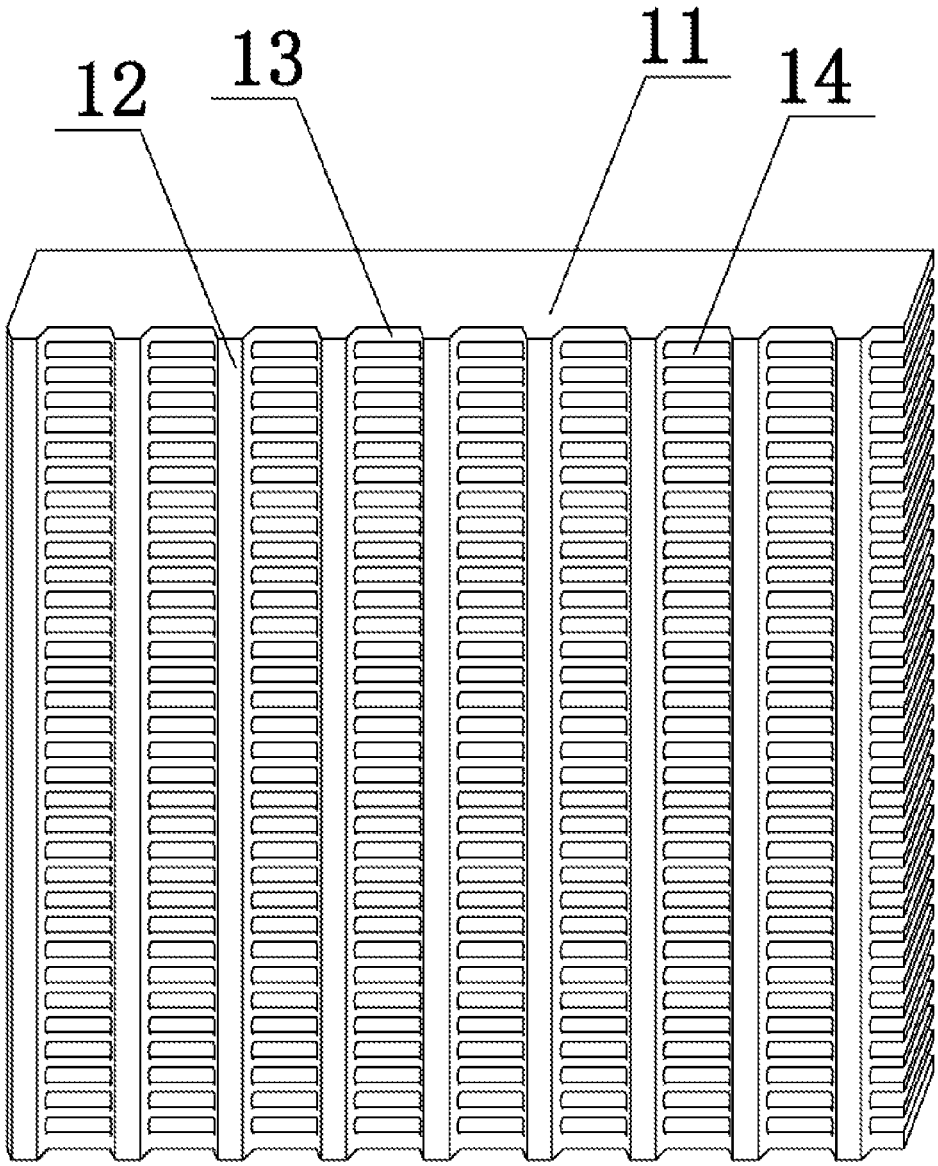
FIG. 2 is a sketch view of a jaw plate according to the preferred embodiment of the present invention.
Figure 3:
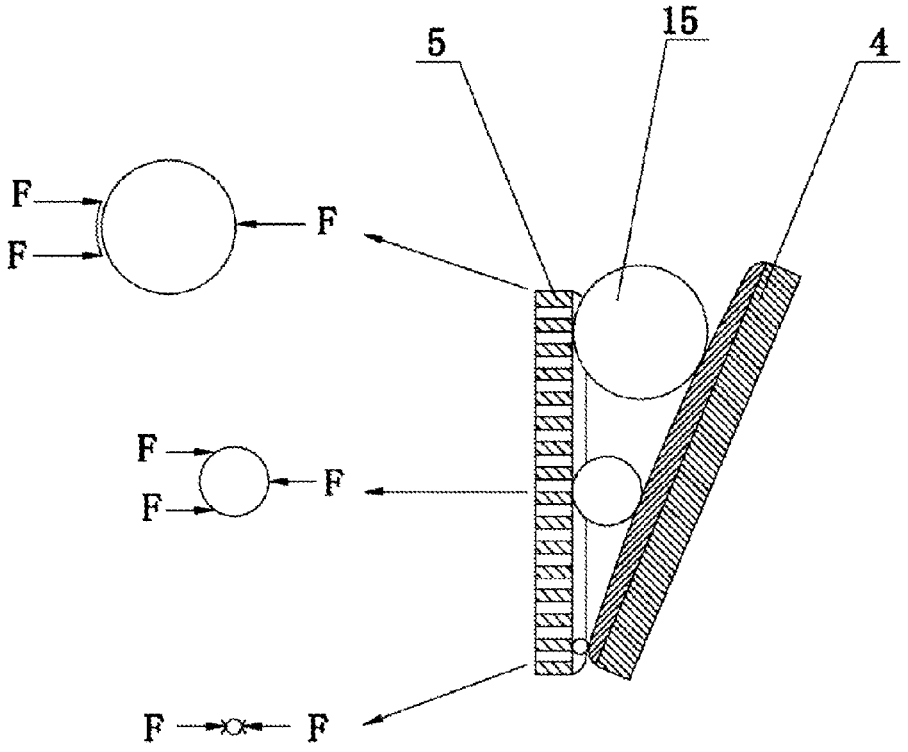
FIG. 3 is a sketch view of states of crushing ores according to the preferred embodiment of the present invention, wherein stress diagrams of the ores are showed left.

Referring to FIG. 2, the tooth trough 13 has through-holes 14 perforated through the base board 11, wherein the through-holes 14 are waist-shaped. The through-holes 14 are arranged in columns along a direction of a length of the tooth peak 12 on the base board 11 opposite to the through-holes 14 and the different through-holes 14 on the same tooth trough 13 are evenly spaced. A total area of all the through-holes 14 within one tooth trough 13 is 40% of a total area of the tooth trough 13.

According to the preferred embodiment of the present invention, the multi-functional pair of crushing plates is applied as follows. Firstly, ores 15 at a top part are crushed via a chopping manner because the ores 15 at the top part are relatively big and a distance between the two tooth peaks is negligible; secondly, ores 15 at an intermediate part are crushed via a bending manner because the ores 15 at the intermediate part are relatively moderate in size and mutually stressed points between the tooth peaks and the opposite tooth peaks are obviously staggered, which is to say that the distance between the two tooth peaks is functional; thirdly, ores 15 at a bottom part are crushed via a squeezing manner (a pressing manner) because the ores 15 at the bottom part are relatively small and able to enter the tooth troughs. The above crushing manners greatly improve crushing capability and crushing efficiency. The opposite and intersect tooth peaks and tooth troughs of the fixed jaw plate and the movable jaw plate reduce a size of an exit provided at a lower part of a crushing cavity, which means that the exit discharges the crushed ores having a reduced grain size.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multi-functional pair of crushing plates capable of self-trimming, comprising a fixed jaw plate and a movable jaw plate which form a V shape, wherein said fixed jaw plate and said movable jaw plate both have base boards; each of said base boards respectively has a plurality of teeth to form tooth peaks and tooth troughs; said tooth peaks and said tooth troughs respectively provided on said two base boards are arranged oppositely and intersectedly; each of said tooth troughs is 1.5-4 time wider than each of said tooth peaks; each of said tooth troughs has holes which are arranged in a column along a direction of a length of each of said tooth peaks on said base board opposite to said holes, wherein a total area of all said holes within each of said tooth troughs is 40%-80% of a total area of each of said tooth troughs, in such a manner that said tooth troughs and said tooth peaks are alternatively worn during crushing, so as to accomplish self-trimming.

2. The multi-functional pair of crushing plates capable of self-trimming, as recited in claim 1, wherein said holes are through-holes perforated through said base boards.

3. The multi-functional pair of crushing plates capable of self-trimming, as recited in claim 2, wherein: said holes are kidney-shaped, elliptical, rectangular or rhombic; said holes within each of said tooth troughs are evenly spaced.

4. The multi-functional pair of crushing plates capable of self-trimming, as recited in claim 1, wherein: said holes are kidney-shaped, elliptical, rectangular or rhombic; said holes within each of said tooth troughs are evenly spaced.

* * * * *